US005513469A

United States Patent [19]

Tajudeen et al.

[11] Patent Number: 5,513,469

[45] Date of Patent: May 7, 1996

[54] RETRACTABLE SLIDING DOOR

[76] Inventors: Eddie R. Tajudeen; Lisa A. Tajudeen, both of 638 Appleton Dr., Ovideo, Fla. 32765

[21] Appl. No.: 394,881

[22] Filed: Feb. 27, 1995

[51] Int. Cl.[6] ..... E05D 15/06

[52] U.S. Cl. ..... 49/404

[58] Field of Search ..... 49/404, 445, 386, 49/446; 16/197; 160/84.04

[56] References Cited

U.S. PATENT DOCUMENTS

| | | | |
|---|---|---|---|
| 2,992,450 | 1/1959 | Pittenger | 16/78 |
| 3,246,363 | 4/1966 | Rogas | 16/78 |
| 3,267,513 | 8/1966 | Wartian | 16/67 |
| 3,475,865 | 11/1969 | Arnes | 49/445 |
| 3,480,227 | 11/1969 | Matthews | 242/107.3 |
| 3,618,262 | 3/1970 | Tuhro | 49/404 |
| 3,992,751 | 11/1976 | Foster et al. | 49/445 X |
| 4,004,372 | 1/1977 | Beard et al. | 49/404 |
| 4,301,623 | 11/1981 | Demukai | 49/404 |
| 4,675,938 | 6/1987 | Bundschuh | 16/63 |
| 4,757,642 | 7/1988 | Hahn | 49/404 X |
| 4,935,987 | 6/1990 | Sterner, Jr. | 49/445 X |
| 5,105,867 | 4/1992 | Coslett | 160/84.04 |
| 5,353,548 | 10/1994 | Westfall | 49/46 |

*Primary Examiner*—Philip C. Kannan
*Attorney, Agent, or Firm*—William M. Hobby, III

[57] ABSTRACT

A retractable sliding door apparatus includes a door housing, a sliding door slidably mounted in the door housing, and a retractable spring mechanism mounted to the door housing and to the sliding door for retracting an open door to a closed position. The retractable spring mechanism includes a spring drum having a constant force retractable spring attached to it and in which the constant force retractable spring has one end attached to a bracket mounted on the door. The constant force retractable spring is made of a spiral strip of steel which has been heat treated while coiled to a predetermined curvature so that when the steel is extended, the stress in the steel resists the loading force at an approximate constant rate so that the sliding door is opened against a generally constant force and returns from an open to a closed position at a generally constant rate of movement under the force of a constant force spring to thereby avoid the door slamming shut.

6 Claims, 1 Drawing Sheet

RETRACTABLE SLIDING DOOR

BACKGROUND OF THE INVENTION

The present invention relates to a retractable sliding door and especially to a retractable door having a constant force spring which allows the door to be opened with a constant force over its sliding range.

In the past, there have been a number of closure mechanisms for sliding doors which have included various types of spring mechanisms including a spring biased reel having a band wound on the outer surface of the reel which is connected to the door. In these prior closure mechanisms, the spring is so wound that when the sliding door is opened, the flexible band plays off the reel and the tension of the spring increases. Upon release of the door, the force of the spring winds in the flexible band and pulls the door to a closed position. Because of the distance in which the springs have been extended and the increased spring tension as the door is pulled to a fully opened position, the doors require a much greater force to open wide and, when released, are returned by the spring with a much greater force which tends to slam the door shut. This has generally made a retractable door closure impractical. Some of the prior art devices have had mechanisms for adjusting the tension of the springs. Such mechanisms tend to have various disadvantages including being costly to manufacture and some have springs that slip so that the door does not fully close each time.

Prior art U.S. patents which provide for closure mechanisms for sliding doors can be seen in U.S. Pat. No. 3,246,363 to Rogas et al. which has a coil spring return door closure mechanism provided with means for adjusting the tension of the spring including a ratchet wheel affixed to the shaft which carries the coil spring in the closure and a pawl on the front wall of a housing of the closure which engages the ratchet wheel to provide a positive locking mechanism for the spring adjusting means. In the Demukai patent, No. 4,301,623, a semi-automatic sliding door device has a tension spring and is equipped with a braking device to prevent the rapid return of the door. The braking device includes permanent magnets on the outer framework and a braking plate made of copper or aluminum sheets on the sliding door so that the length of elongation of the tension spring can be reduced relative to the length of the sliding door. In the Wartian U.S. Pat. No. 3,267,513, a closure for a sliding door is provided which controls the closing movement of the door to avoid slamming or incomplete closing of the door. The control is achieved with a coil spring and pneumatic bleed closing system in which the coil spring and pneumatic bleed are independently adjustable without disassembly of the door closer. The Pittenger U.S. Pat. No. 2,992,450, is also a door closure mechanism for use with sliding doors which uses a rotatable mounted reel which carries a cable which extends from the housing for attachment to the frame of the door and which automatically varies the angle of the component of force exerted by the door closing mechanism as the door progresses along its path of travel so that the door is caused to close gently without slamming. In this patent, the coil spring and the reel that it rides on is attached to the door and moves with the door with the end of the spring loaded coil attached to the frame so that the angle of the cord extending from the reel attached to the door and the frame changes as the door is opened or closed.

In the Bundschuh patent, No. 4,675,938, a retractable device for doors or windows is provided for automatically closing the door after the door has been opened. This retractable device includes a drum having a coil spring power assembly for driving the drum along with a centrifugal brake for controlling the power assembly in the drum to eliminate slamming of the door during closing. A gear train transmission assembly connects the power assembly in the centrifugal brake. In the Matthews, U.S. Pat. No. 3,480,227, a retractable device with a compensating brake is used as a retractor for sliding screen doors or the like. The amount of braking force applied is controlled by the amount of tension on the cable to prevent the tendency of a spring to slam a door shut. The greatest braking action is applied at the start of the retraction of the door when the force of the spring is greatest and reduced as the spring action force diminishes.

The present invention uses a simplified constant force spring incorporated into a retractable sliding door mechanism which prevents the slamming of the door and does not increase the force in opening the door as the door is opened wider and which can have the constant force spring capacity multiplied by using two or more springs in tandem. The spring uses a band of steel tightly wrapped on a rod and heat treated to develop an inherent stress or memory to control the force of the spring during reeling and unreeling.

SUMMARY OF THE INVENTION

A retractable sliding door apparatus includes a door housing, a sliding door slidable mounted in the door housing, and a retractable spring mechanism mounted to the door housing and to the sliding door for retracting an open door to a closed position. The retractable spring mechanism includes a spring drum having a constant force retractable spring attached to it and in which the constant force retractable spring has one end attached to a bracket mounted on the door. The constant force retractable spring is made of a spiral strip of steel which has been heat treated while coiled to a predetermined curvature so that when the steel is extended, the stress in the steel resists the loading force at an approximate constant rate so that the sliding door is opened against a generally constant force and returns from an open to a closed position at a generally constant rate of movement under the force of a constant force spring to thereby avoid the door slamming shut. The constant force spring provides the same return force when slightly extended as when fully extended, thereby eliminating any need for compensators to resist slamming.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
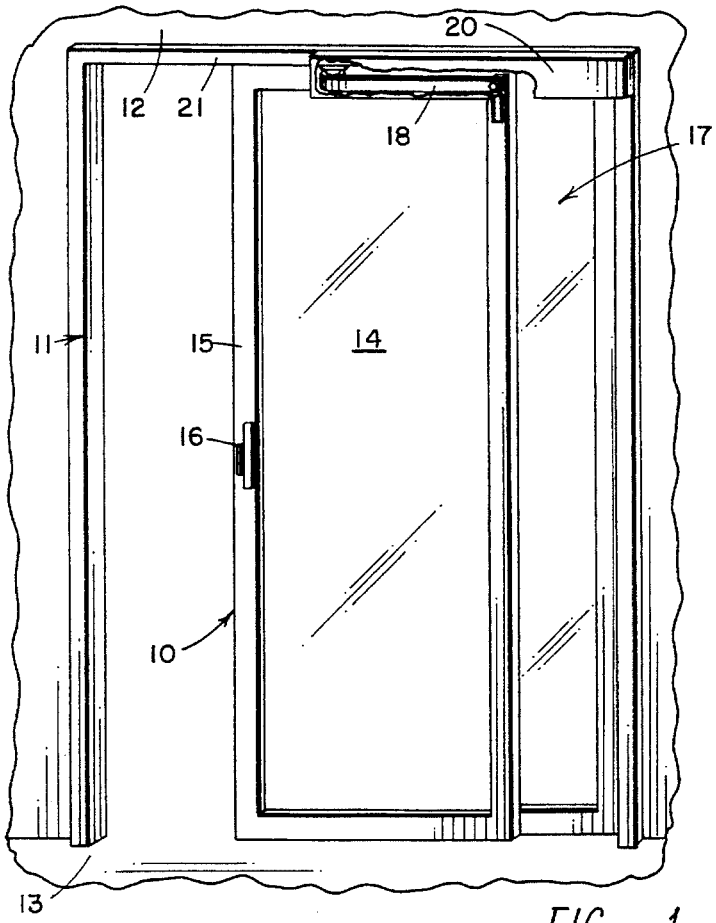
FIG. 1 is a cutaway of a sliding glass door mounted in a door housing or frame and having a retractable spring mechanism mounted thereto in accordance with the present invention.
Figure 2:
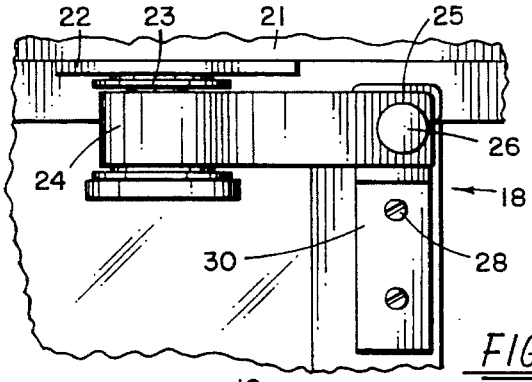
FIG. 2 is a side elevation of the retractable spring mechanism attached to a door of FIG. 1.
Figure 3:
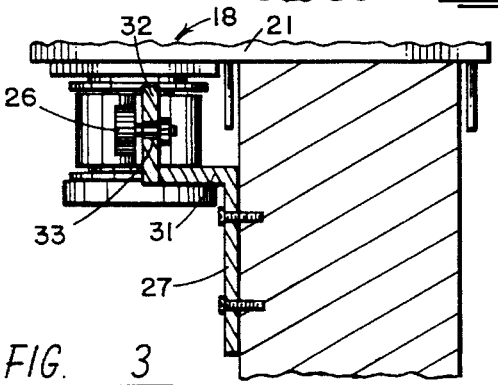
FIG. 3 is an end elevation of the retractable spring mechanism of FIG. 2.

Referring to the drawings and especially to FIGS. 1–4, a sliding glass door 10 is slidably mounted in a door frame or housing it formed in a wall 12 and riding on the floor 13 of a room. The sliding door 10 includes a glass panel 14 mounted in an aluminum frame 15 and having a handle and lock 16 and slides adjacent and parallel to a second sliding glass door 17. The door has a retractable spring mechanism 18 mounted to the top thereof and has a cover valance 20. Spring mechanism 18, as seen in FIGS. 2 and 3, is mounted to the top frame member 21 with a base plate 22 which may be bolted or otherwise attached to top frame member 21. A drum 23 is rotatably mounted on a shaft to the base 22 and a constant force spring wrapped therearound. The end 25 of the constant force spring is attached with an attachment member or bearing 26 to the door bracket 27. Door bracket 27 is shown bolted with threaded fasteners 28 to the aluminum frame portion 30 of the door frame of door 10. The bracket 27 is shown flat against the frame member 30 but with a horizontal portion 31 extending from the door and an upright portion 32 extending from the horizontal portion 31 and having an opening 33 therethrough for attaching the spring with the bearing 26.

In operation, the door 10, as shown in FIG. 1 is pulled open by the handle 16 which pulls the constant force spring from the bearing 26 off of the drum 23 attached to the frame portion 21. The constant force spring allows the door to be pulled with a constant force continuously from a closed position to a wide open position and, when released, the force remains constant over the length of the open door so that the door is returned at a steady rate under the pull of the constant force spring 24 to close without slamming. The constant force spring 24 is a special variation of an extension spring in which a spiral strip of steel has a built-in curvature formed therein as it is wrapped around a rod or other member with each turn of the strip wrapped tightly on its inner neighbor and, when the wrapped steel is heat treated, it develops an inherent stress or memory. A type 301 stainless steel may be utilized in the present springs. When the steel strip is extended or deflected, the inherent stress or memory resist the loading force just as in a common extension spring but at a nearly constant or zero rate so that the constant force spring becomes well suited for long extensions where no build up of load is desired, as in the case of the present sliding doors.

Figure 5:
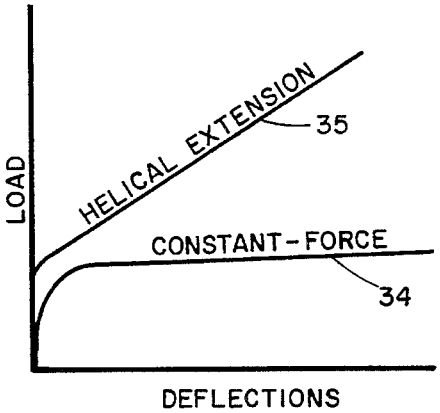
FIG. 5 shows a typical load deflection curve for a constant force spring and a typical helical extension spring.

FIG. 5 illustrates a typical load/deflection curves for a constant force spring shown by the curve 34 while the conventional helical extension spring load/deflection is shown by curve 35. As seen in FIG. 5, the coil spring has a direct increase in the load responsive to the increased deflection which makes the spring harder to extend over greater distances and, when released, such as in the present application, produces a much greater return momentum which results in the door slamming into the frame 11. A constant force spring, as shown in the chart, maintains a constant load for most of the length of the spring deflection so that the door is opened with a constant resisting force and then closes under the return of the spring under a constant force.

Figure 4:
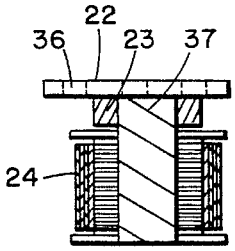
FIG. 4 is a sectional view through the retractable spring mechanism drum and spring.

In FIG. 4, the drum 23 is mounted to the face 22 which has a plurality of openings 36 therein for bolting the spring mechanism to the frame 21. The spring 24 is tightly wrapped on the drum and the drum rotates on a center post 37.

Figure 6:
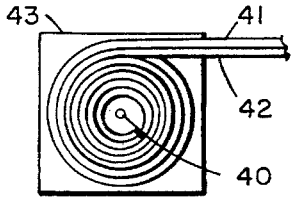
FIG. 6 is a side sectional view on a second embodiment of a constant force spring mechanism using two springs strips in tandem.

In FIG. 6, a pair of constant force springs in accordance with the present invention are wrapped in laminated fashion onto a drum 40. The upper laminated spring 40 and the lower laminated spring 42 are wrapped together which allow load capacity of the spring to be multiplied by two with the use of two strips in laminated fashion. The drum 40 is mounted to the base 43. Two springs 41 and 42 mounted in laminated fashion produce a constant force over the length of the spring members but at approximately double the force of a single spring of similar size.

Figure 7:
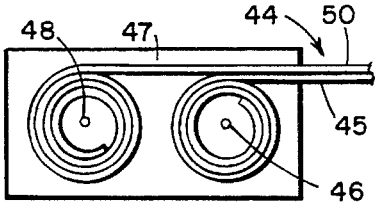
FIG. 7 is yet another embodiment using two constant force springs mounted back-to-back for doubling the load capacity of the springs.

Referring to FIG. 7, a constant force spring 44 has a lower spring 45 mounted on a drum 46 which rotates on a base 47. A second drum 48 has a second constant force spring 50 rotatably mounted thereon. Drum 48 is also mounted to the base 47 so that both springs can be reeled off their respective drums 46 and 48 simultaneously and will reel off in a laminated fashion for again doubling the constant force of an individual spring. The embodiment shown in FIGS. 6 and 7 allows smaller springs to be used for obtaining a desired load on any particular door.

It should be clear at this time that a retractable sliding door has been provided which both simplifies the operation of a retractable door while simultaneously avoiding the problems of the door slamming and substantially decreased force for a wider opening of the door. It will, of course, be clear that the retractable sliding door can be a glass door as well as solid panels or screen doors as desired without departing from the spirit and scope of the invention. Accordingly, the present invention is not to be construed as limited to the forms shown which are to be considered illustrative rather than restrictive.

We claim:

1. A retractable sliding door comprising:

a door housing;

a sliding door slidably mounted in said door housing;

a retractable spring mechanism attached to said door housing along one side of said sliding door and having a spring drum having two laminated constant force retractable springs attached together and to said spring drum, said laminated constant force retractable springs being removably attached to a bracket attached to one side of said sliding door and adapted to retract an opened sliding door when said retractable spring is expanded by opening said sliding door, each said constant force spring being made of a spiral strip of steel which has been heat treated while coiled to a predetermined curvature so that when said strip of steel is extended, the stress in the steel resists the loading force at an approximate constant rate, so that said sliding door is opened against a generally constant force of the laminated spring and returns from an open to a closed position at a generally constant rate under the force of the constant force spring; and a cover housing attached to said door housing and covering said retractable spring mechanism.

2. A retractable sliding door in accordance with claim 1 in which said constant force retractable spring includes two constant force retractable springs mounted in tandem for uncoiling together.

3. A retractable sliding door in accordance with claim 1 in which said constant force retractable spring includes two constant force retractable springs mounted back to back for uncoiling together.

4. A retractable sliding door in accordance with claim 1 in which said constant force retractable spring is an elongated spring of a length having at least 1 and ½ coils on said drum when said retractable door is fully opened.

5. A retractable sliding door in accordance with claim 4 including two retractable doors, each having a retractable spring mechanism.

6. A retractable sliding door in accordance with claim 1 in which each of said retractable laminated springs is made of type 301 stainless steel.

* * * * *